US010753610B2

(12) United States Patent
Pucci et al.

(10) Patent No.: US 10,753,610 B2
(45) Date of Patent: Aug. 25, 2020

(54) INTERCHANGEABLE LINER SUPPORT FOR GAS TURBINE COMBUSTERS

(71) Applicant: Nuovo Pignone Tecnologie Srl, Florence (IT)

(72) Inventors: Egidio Pucci, Florence (IT); Michele Provenzale, Florence (IT)

(73) Assignee: NUOVO PIGNONE SRL, Florence (IT)

( * ) Notice: Subject to any disclaimer, the term of this patent is extended or adjusted under 35 U.S.C. 154(b) by 193 days.

(21) Appl. No.: 15/562,905

(22) PCT Filed: Mar. 29, 2016

(86) PCT No.: PCT/EP2016/056759
§ 371 (c)(1),
(2) Date: Sep. 29, 2017

(87) PCT Pub. No.: WO2016/156285
PCT Pub. Date: Oct. 6, 2016

(65) Prior Publication Data

US 2018/0080650 A1 Mar. 22, 2018

(30) Foreign Application Priority Data

Mar. 30, 2015 (IT) ..... FI2015A0089

(51) Int. Cl.
*F23R 3/60* (2006.01)
*F23M 5/04* (2006.01)
*F23R 3/00* (2006.01)

(52) U.S. Cl.
CPC ..... *F23R 3/002* (2013.01); *F23M 5/04* (2013.01); *F23R 3/60* (2013.01); *F23R 2900/00017* (2013.01)

(58) Field of Classification Search
CPC .... F23R 3/60; F23R 3/46; F23R 2900/00017; F23R 2900/00018; F23R 2900/00019; F23R 3/002; F23M 5/04; F02K 1/822
See application file for complete search history.

(56) References Cited

U.S. PATENT DOCUMENTS 5,749,218 A * 5/1998 Cromer ..... B23P 6/002 60/39.37
7,762,075 B2 * 7/2010 Pangle ..... F02C 7/20 60/752

(Continued)

FOREIGN PATENT DOCUMENTS

CN 102383938 A 3/2012
DE 10 2008 002 981 A1 2/2009

(Continued)

OTHER PUBLICATIONS

First Office Action and Search issued in connection with corresponding CN Application No. 201680020071.5 dated Nov. 22, 2018.

(Continued)

*Primary Examiner* — Scott J Walthour
*Assistant Examiner* — Todd N Jordan
(74) *Attorney, Agent, or Firm* — Baker Hughes Patent Organization

(57) ABSTRACT

A gas turbine combustor is disclosed, comprising: a combustor liner; a combustor casing, at least partly housing the combustor liner, and a liner support arrangement. The liner support arrangement comprises individual support elements located between the combustor liner and the combustor casing. Each support element comprises a liner support member fixed to the combustor liner and a casing support member fastened to the combustor casing. Each casing support member comprises a casing stop seat fixed on the (Continued)

combustor casing and a replaceable casing stop, detachably coupled to the casing stop seat.

13 Claims, 6 Drawing Sheets

(56) References Cited

U.S. PATENT DOCUMENTS

| | | | | |
|---|---|---|---|---|
| 8,869,536 | B2 * | 10/2014 | Clifford | F23J 13/00 60/752 |
| 8,925,326 | B2 * | 1/2015 | Cihlar | F23R 3/002 60/752 |
| 9,435,535 | B2 * | 9/2016 | Desai | F23R 3/002 |
| 9,696,037 | B2 * | 7/2017 | Kidder | F23R 3/60 |
| 2006/0130486 | A1 | 6/2006 | Danis et al. | |
| 2009/0044540 | A1 | 2/2009 | Pangle et al. | |
| 2012/0036857 | A1 * | 2/2012 | Bassani | F23R 3/60 60/752 |
| 2014/0026581 | A1 | 1/2014 | Clifford et al. | |

FOREIGN PATENT DOCUMENTS

| | | | |
|---|---|---|---|
| DE | 10 2008002981 | A1 | 2/2009 |
| EP | 2 402 566 | A2 | 1/2012 |
| EP | 2 629 014 | A2 | 8/2013 |

OTHER PUBLICATIONS

Italian Search Report and Written Opinion issued in connection with corresponding IT Application No. FI2015A000089 dated Nov. 17, 2015.

International Search Report and Written Opinion issued in connection with corresponding PCT Application No. PCT/EP2016/056759 dated Jun. 8, 2016.

International Preliminary Report on Patentability issued in connection with corresponding PCT Application No. PCT/EP2016/056759 dated Oct. 3, 2017.

* cited by examiner

INTERCHANGEABLE LINER SUPPORT FOR GAS TURBINE COMBUSTERS

BACKGROUND OF THE INVENTION

Embodiments of the subject matter disclosed herein generally relate to mechanisms for supporting a liner in a gas turbine combustor, and more particularly, to spring loaded liner support mechanisms.

In a conventional gas turbine engine, air is ingested by a compressor, compressed and delivered to a combustor. The compressed air is mixed with fuel in the combustor and the air-fuel mixture is burned yielding hot, pressurized combustion gases. The combustion gases are expanded in a turbine, including one or more turbine wheels. Expansion of the combustion gases drives the turbine into rotation, thus producing useful mechanical power. The mechanical power is partly used for driving the compressor. Additional mechanical power is available on a turbine output shaft, for driving a load, such as a rotating turbomachinery, an electric generator or the like. The combustion process may occur inside a combustor liner. In some known combustors, the combustor liner is supported and at least partly housed in a combustor casing. In some embodiments a single casing of annular shape houses a plurality of combustor liners. In other embodiments, each combustor liner is housed in a respective combustor casing. The combustor liner and the combustor casing are substantially coaxial.

The compressed air and fuel are input and mixed at a rear end of the combustor liner. The combustion gases are output through an aft end of the combustor liner. The aft end is downstream in the gas flow direction from the rear end. The combustion gases are delivered from the combustor liner towards the turbine, where they are expanded. A transition piece fluidly connects the combustor liner and the turbine. A hula seal is usually interposed between the aft end of the combustor liner and the transition piece, the arrangement being such as to accommodate displacements due to thermal expansion and vibration of the combustor components.

Heat and vibration from the combustion process, as well as other mechanical loads and stresses from the gas turbine, e.g. due to unbalance of the compressor and/or turbine rotor, shake, rattle and otherwise cause vibrations of the combustor liner and the other components of the gas turbine in the proximity of the combustor liner. Accordingly, the combustor liner should be mounted such as to withstand the heat, vibrations and loads imposed by the combustion and other forces.

Typically a liner support arrangement is mounted close to the rear end of the combustor liner, between the combustor liner and the combustor casing. A typical liner support arrangement includes three individual support elements disposed between the combustor liner and the combustor casing, around a section substantially perpendicular on the gas flow direction in the combustor. Each support element typically includes a liner stop, which is constrained to the combustor liner, and a casing stop, which is constrained to the combustor casing. Each liner stop co-acts with the respective casing stop to support the combustor liner. A spring arrangement is usually located between the casing stop and the liner stop.

As mentioned above, due to the combustion process, as well as to the rotary motion of compressor and turbine, the combustor liner is subjected to vibrations, which cause wear of the interfaces between the combustor casing and the combustor liner. In particular, support elements which connect the combustor liner to the combustor casing are subject to wear and must be frequently replaced.

Existing combustors are designed such that the combustor liner can easily be demounted from the combustor casing for repairing or replacement purposes, along with the liner stops and relevant springs. Combustor casings are subject to less frequent maintenance and replacement interventions. Nevertheless, if the casing stops are worn out, the combustor casing has to be removed and the casing stops must be disassembled and replaced before the combustor casing can be mounted on the gas turbine engine again.

Removal of the combustor casing is a long-lasting operation and causes the gas turbine engine to remain inoperative for relatively long periods of time.

Accordingly, it would be desirable to provide improved combustor liner support arrangements, which solve or alleviates one or more of the drawbacks of known arrangements.

SUMMARY OF THE INVENTION

According to an exemplary embodiment, a gas turbine combustor is provided, comprising a combustor liner and a combustor casing. The combustor liner is arranged at least partially within the combustor casing. The combustor further comprises a liner support arrangement, having individual support elements located between the combustor liner and the combustor casing. Each support element comprises a liner support member fixed to the combustor liner and a casing support member fastened to the combustor casing. Each casing support member comprises a casing stop seat fixed on the combustor casing and an interchangeable, i.e. replaceable casing stop, detachably coupled to the casing stop seat. The replaceable casing stop can be subject to wear, e.g. due to vibrations. By making the casing support member in two parts, namely a casing stop seat fixed to the combustor casing and an interchangeable, i.e. replaceable casing stop, the latter an can be easily removed from the casing stop seat and replaced in case of wear or damage, for instance. The combustor casing does not have to be disassembled, such that replacement of the worn portions of the casing support member is made easier and quicker.

The casing stop seat and the interchangeable or replaceable casing stop can be connected to one another with any suitable means which allows easy detachment of the interchangeable, i.e. replaceable casing stop, without dismantling or damaging the casing stop seat. For instance, bolts or screw fastening members can be used.

By fastening the interchangeable, i.e. replaceable casing stop to the casing stop seat in such a way that the two components are substantially free of mutual displacements due to vibrations, no wear of the surfaces of mutual contact between casing stop and casing stop seat occurs. The casing stop seat does thus not require replacement.

The casing stop seat can thus be fixed to the combustor casing in an irreversible manner, e.g. by welding or soldering.

According to some embodiments, each support element comprises at least one spring member arranged between the casing support member and the liner support member. The spring member can be preloaded, to provide a bilateral resilient constraint. The bilateral resilient, i.e. elastic constraint can be oriented tangentially.

The casing stop and the liner stop comprise respectively a female part and a male part, or vice versa. The male part and the female part are configured and arranged such that the female part receives and retains therein the male part. The spring member can be located between the male part and the female part, elastically loading the male part and the female part one with respect to the other.

The subject matter disclosed herein further comprises a gas turbine engine comprising a compressor section, a combustor section and a turbine section, wherein the combustor section comprises at least one gas turbine combustor as defined above.

According to a further aspect, disclosed herein is a method for replacing worn components of a gas turbine engine combustor, comprising the following steps:

- providing at least a combustor with a combustor liner and a combustor casing, in which the combustor liner is at least partly housed;
- providing a plurality of support elements connecting the combustor liner to the combustor casing, each support element comprising a liner support member and a casing support member; wherein the casing support member comprises a casing stop seat constrained to the combustor casing and a casing stop mounted in the casing stop seat;
- removing the combustor liner from the combustor casing;
- disengaging at least one casing stop from the respective casing stop seat;
- introducing a new casing stop in the casing stop seat;
- locking the new casing stop in the casing stop seat;
- mounting the combustor liner or a new combustor liner in the combustor casing.

Features and embodiments are disclosed here below and are further set forth in the appended claims, which form an integral part of the present description. The above brief description sets forth features of the various embodiments of the present invention in order that the detailed description that follows may be better understood and in order that the present contributions to the art may be better appreciated. There are, of course, other features of the invention that will be described hereinafter and which will be set forth in the appended claims. In this respect, before explaining several embodiments of the invention in details, it is understood that the various embodiments of the invention are not limited in their application to the details of the construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which the disclosure is based, may readily be utilized as a basis for designing other structures, methods, and/or systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

A more complete appreciation of the disclosed embodiments of the invention and many of the attendant advantages thereof will be readily obtained as the same becomes better understood by reference to the following detailed description when considered in connection with the accompanying drawings, wherein.

DETAILED DESCRIPTION

The following detailed description of the exemplary embodiments refers to the accompanying drawings. The same reference numbers in different drawings identify the same or similar elements. Additionally, the drawings are not necessarily drawn to scale. Also, the following detailed description does not limit the invention. Instead, the scope of the invention is defined by the appended claims.

Reference throughout the specification to "one embodiment" or "an embodiment" or "some embodiments" means that the particular feature, structure or characteristic described in connection with an embodiment is included in at least one embodiment of the subject matter disclosed. Thus, the appearance of the phrase "in one embodiment" or "in an embodiment" or "in some embodiments" in various places throughout the specification is not necessarily referring to the same embodiment(s). Further, the particular features, structures or characteristics may be combined in any suitable manner in one or more embodiments.

The following description specifically relates to a so-called tubular combustor, wherein a single combustor liner is at least partly housed within a combustor casing, and wherein the combustor liner and the combustor casing are substantially coaxial. Some of the features disclosed herein, however, can be also used in so-called tubo-annular combustors, wherein an annular combustor casing houses a plurality of combustor liners, positioned around the axis of the annular combustor casing.

Figure 1:
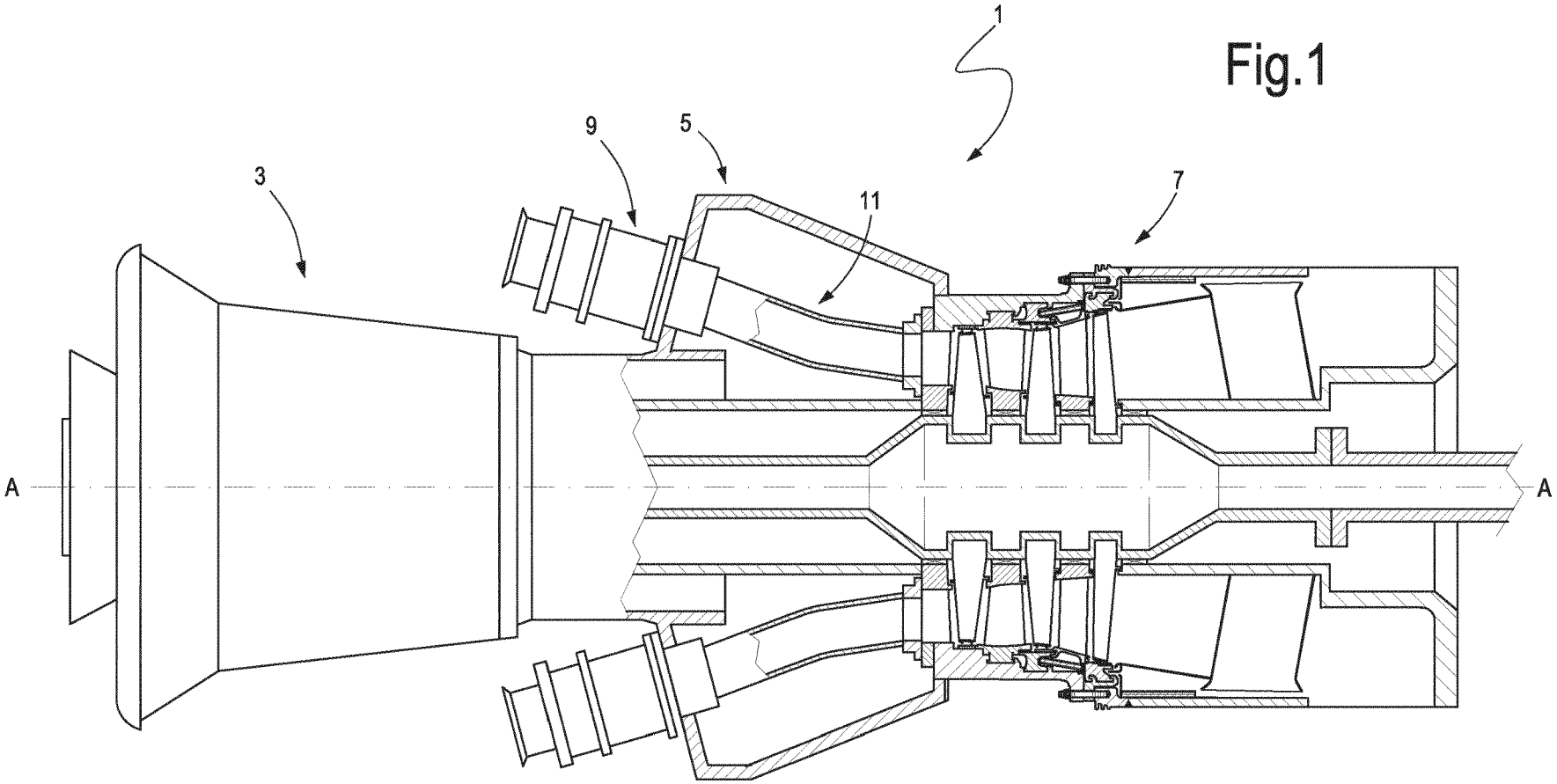
FIG. 1 schematically illustrates a gas turbine engine.

FIG. 1 schematically illustrates a gas turbine engine 1, which includes a compressor section 3, a combustor section 5 and a turbine section 7. Air ingested by the compressor 3 is compressed and delivered to the combustor section 5, wherein fuel is added to the compressed air flow and the fuel/air mixture is burned, generating combustion gases at high temperature and pressure. The hot pressurized combustion gasses are delivered to the turbine section 7 and caused to expand, generating power which is available on the turbine shaft or shafts, for driving the compressor section 3 and for mechanically driving a load coupled to the turbine shaft and not-shown.

As schematically illustrated in FIG. 1, the combustor section 5 comprises one or more combustors 9 which can be circularly arranged around axis A-A of the gas turbine engine 1. Each combustor 9 is fluidly coupled through a transition piece 11 with the first stage of the turbine section 7, for delivering the hot pressurized combustion gases to the turbine section 7.

Figure 2:
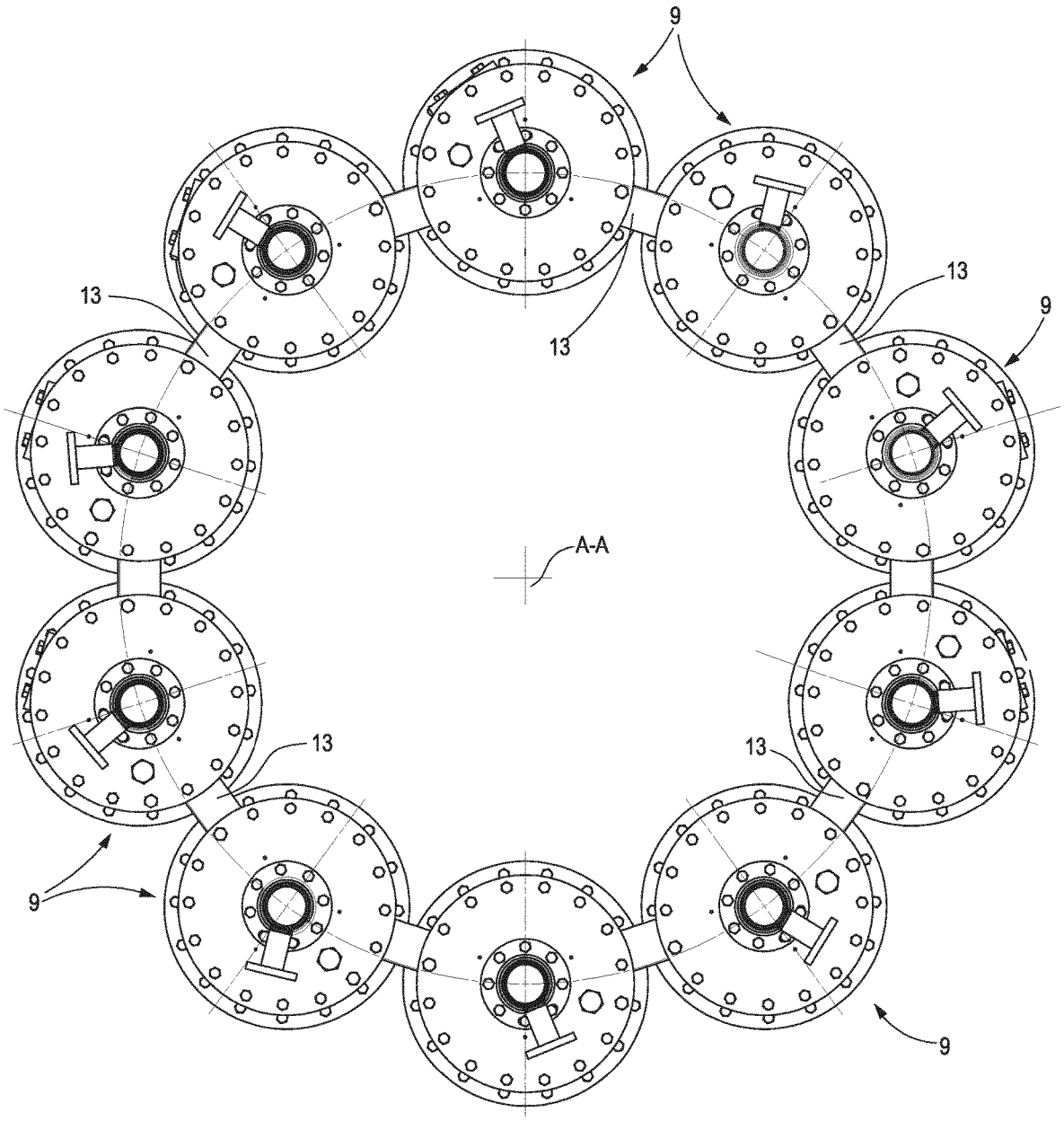
FIG. 2 illustrates an arrangement of combustors in a combustor section of the gas turbine engine.

FIG. 2 schematically illustrates a back view of a plurality of combustors 9 circularly arranged around the axis A-A of the gas turbine engine 1.

Embodiments disclosed herein specifically concern so-called tubular combustors. As known to those skilled in the art, each tubular combustor 9 can be comprised of a combustor liner and a combustor casing, which can be arranged substantially coaxially with one another, the combustor liner being supported within the combustor casing. Cross-fire tubes 13 connect each combustor 9 to the two adjacent combustors 9. This allows hot combustion gases from one combustor 9 to travel through the cross-fire tubes 13 to provide an ignition source in the adjacent combustors.

Figure 3:
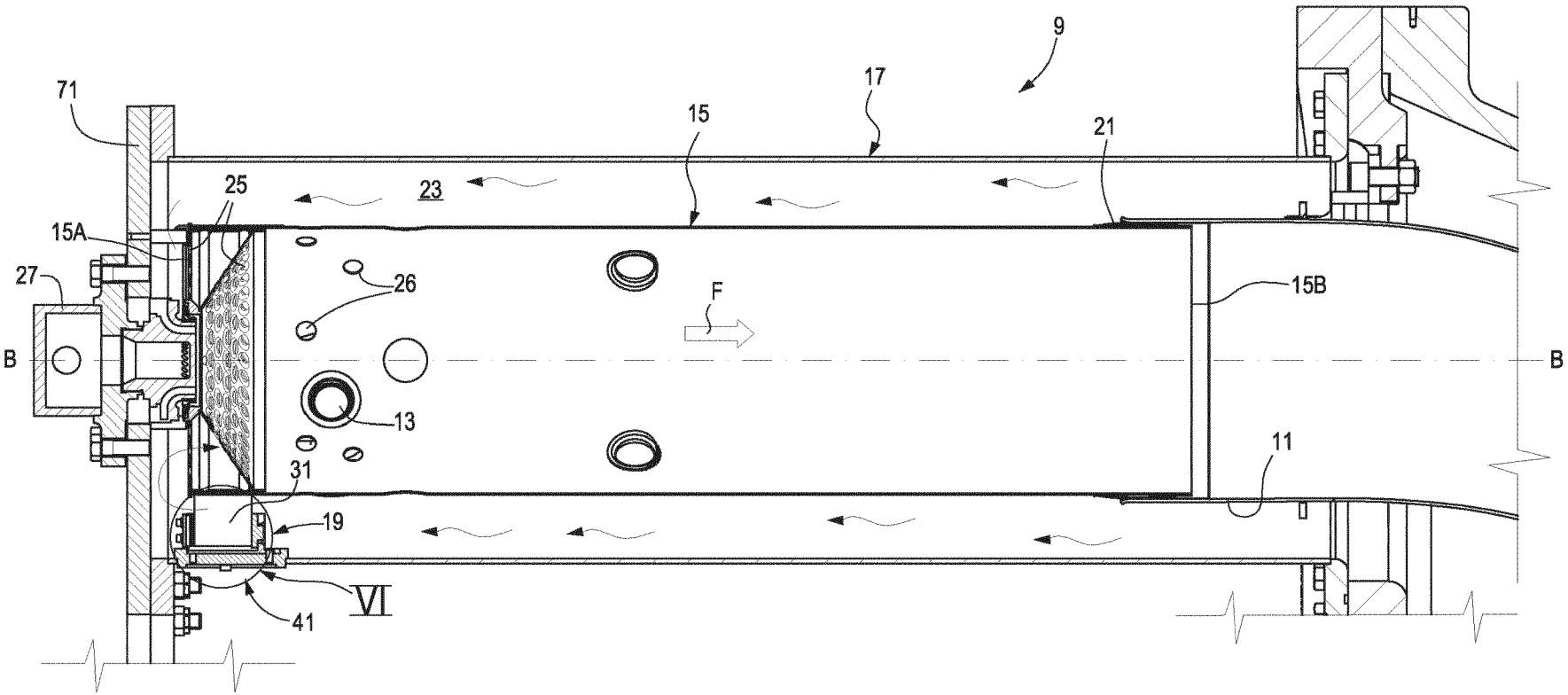
FIG. 3 illustrates a sectional view of a combustor comprised of a combustor casing and a combustor liner coaxially supported in the combustor casing.

FIG. 3 illustrates a sectional view of one of the tubular combustors 9 forming the combustor section 5 of the gas turbine engine 1. In embodiments disclosed herein, the combustor 9 comprises a combustor liner 15 and a combustor casing 17. In the exemplary embodiment illustrated in FIG. 3, the combustor liner 15 comprises a support end, or upstream end 15A, and a downstream end, or aft end 15B. The definitions "upstream" and "downstream" are referred to the direction F of the combustion gases through the combustor liner 15. The combustor casing 17 and the combustor liner 15 are shown in isolation in FIGS. 4 and 5, respectively.

At the support or rear, upstream end 15A the combustor liner 15 is connected to the outer combustor casing 17 by means of a liner support arrangement, which can comprise a plurality of individual support elements 19. In some embodiments, the liner support arrangement comprises three, angularly spaced individual support elements, arranged for instance at 120° one from the other.

The aft or downstream end 15B of the combustor liner 15 can be provided with a hula seal 21, arranged between the outer surface of the combustor liner 15 and the inner surface of the transition piece 11.

In the exemplary embodiment shown in FIG. 3 the combustor liner 15 is housed in the combustor casing 17 and is arranged substantially coaxially therewith. The longitudinal axis of the combustor 9 is shown at B-B. An annular flow space 23 is thus formed between the externally arranged combustor casing 17 and the internally arranged combustor liner 15. Compressed air provided by the compressor section 3 of the gas turbine engine 1 flows through the annular flow space 23 and enters the combustor liner 15 through an end plate 25 suitably provided with holes for the air flow. Additional air inlet holes 26 are provided on the side cylindrical surface of the combustor liner 15.

A burner 27 is provided at the upstream end 15A of the combustor liner 15. Fuel delivered through the burner 27 is injected in the combustor liner 15 and mixes with the compressed air flowing through the end plate 25 and the holes 26 into the combustion chamber bounded by the combustor liner 15, to generate combustion gases. The combustion gases flow through the transition piece 11 towards the turbine wheels in turbine section 7.

Figure 5:
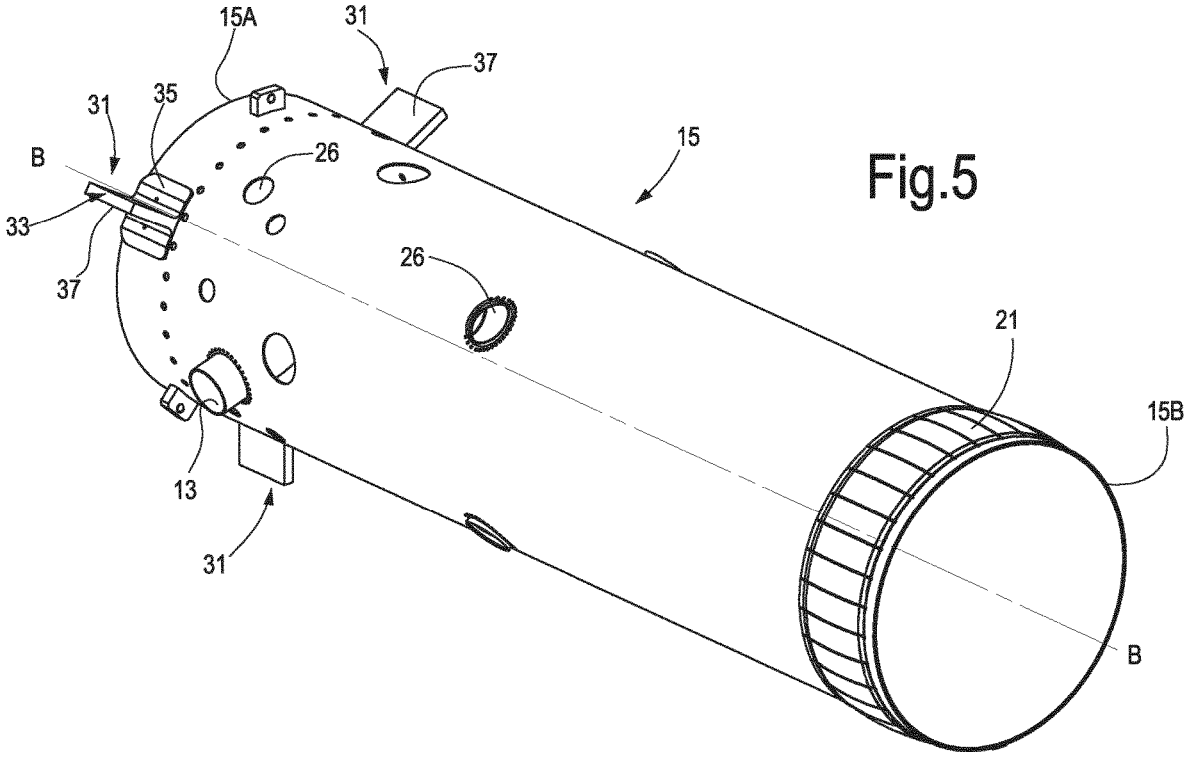
FIG. 5 illustrates a perspective view of a combustor liner.

The individual support elements 19 which connect the combustor liner 15 and the combustor casing 17 to one another can comprise each a liner support member and a casing support member. In FIG. 5 three liner support members 31 are shown, which are spaced apart by 120° degrees one from the other.

Each liner support member 31 can comprise a liner stop 33 comprising a plate 35 and a male part 37. The male part 37 and the plate 35 can be formed as single monolithic piece. The liner stop 33 can be constrained to the outer surface of the combustor liner 15, near or adjacent the upstream end 15A thereof by welding, screwing, bolting or in any other suitable manner. The male part 37 of the liner stop 33 can have a prismatic shape, with the two opposed planar surfaces substantially parallel to a plane containing the axis B-B of the combustor liner 15.

Each liner support element 19 can further comprise a casing support member 41, the structure whereof can be best understood referring to FIGS. 4, 6-9 and 10.

Figure 4:
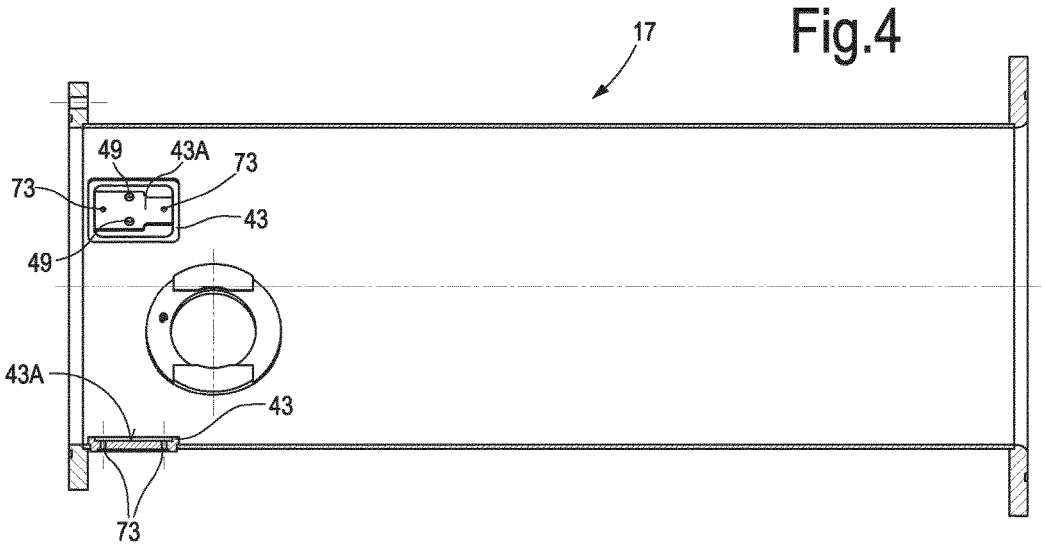
FIG. 4 illustrates a section of a combustor casing.

Each casing support member 41 comprises a casing stop seat 43 and a casing stop 45. The casing stop seat 43 is mounted on the combustor casing 17. In some embodiments the combustor casing 17 can be provided with apertures 42, wherein the casing stop seats 43 are housed. The casing stop seat 43 can be soldered or welded to the combustor casing 17. In FIG. 4 the combustor casing 17 is illustrated in isolation with the casing support members 41 removed except for the casing stop seats 43.

Each casing stop seat 43 is configured and arranged to receive and retain therein a respective casing stop 45. In some embodiments (see in particular FIG. 4) each casing stop seat 43 is provided with a depression 43A having a shape corresponding to the shape of the casing stop 45. In the bottom of the depression 43A of each casing stop 43 through holes 49 can be provided. Each casing stop 45 can be constrained to the respective casing stop seat 43 by means of bolts and related nuts 51, as best shown in the sectional view of FIG. 9. The bolts extend through the holes 49 of the casing stop seat 43. With this arrangement each casing stop 45 becomes easily interchangeable, i.e. replaceable. Indeed, the casing stop 45 can be removed from the casing stop seat 43, by unscrewing the bolts and nuts 51, without the need for disassembling the combustor casing 17 from the combustor 9 and/or the casing stop seats 43 from the combustor casing 17. If a casing stop 45 is damaged or worn out, replacement thereof is thus made possible, without removing the combustor casing 17 from the combustor 9.

Figure 10:
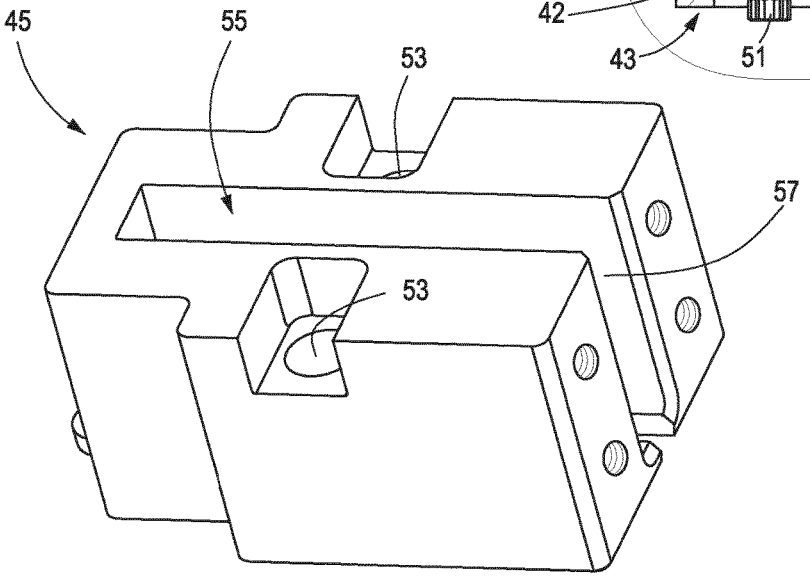
FIG. 10 illustrates an axonometric view of the casing stop.

As best shown in FIG. 10, which illustrates a casing stop 45 in isolation, through holes 53 can be provided in each casing stop 45 for the bolts 51. The holes 53 are arranged on two opposite sides of a female part 55 of the casing stop 45. The female part 55 has a U-shaped cross section extending in the axial direction, i.e. parallel to axis B-B of the combustor 9. A gap 57 is thus defined in the female part 55. The gap 57 extends substantially parallel to the longitudinal axis B-B of the combustor 9 and is open radially inwardly as well as axially opposite the transition piece 11, i.e. towards the upstream end 15A of the combustor liner 15. The male part 37 of the corresponding liner support member 31 can be introduced in the gap 57 of the female part 55 with a movement parallel to the longitudinal axis B-B.

Each casing support member 41 can be comprised of at least one spring member 61 arranged between the casing support member 41 and the respective liner support member 31. In embodiments disclosed herein, each casing support member 41 is provided with two symmetrically arranged springs 61. The springs 61 can be leaf-springs.

Each spring 61 can be provided with an outer bent appendage 61A, which is constrained to the respective casing stop 45, for instance by means of screws 63 and locking plates 65. The leaf springs 61 extend into gap 57 and are in surface contact with the side surfaces thereof. The leaf springs 61 can be curved so that respective convex portions thereof facing each other project towards the interior of gap 57. When the combustor liner 15 is mounted in the combustor casing 17, as shown in FIG. 3, the male part 37 of each liner support member 31 is positioned between the two opposite springs 61 of the respective casing support member 41. The thickness of male part 37, the width of gap 57 and the shape of the springs 61 are such that the springs 61 are partly compressed and preloaded between the side surfaces of gap 57 and side surfaces of the male part 37, thus exerting opposite compressive forces there between. Thus, the springs 61 form a bilateral elastic constraint between the liner stop 33 and the casing stop 45.

In other embodiments, not shown, each liner support member can be provided with a female part and each casing support member can be provided with a male part. In this case the male part of the casing support member can be formed by or be part of the interchangeable, i.e. replaceable casing stop, and can be thus reversibly engaged to the casing stop seat. In this case the female part of the liner support member can be fixed, e.g. soldered or welded, to the combustor liner and removed together with the combustor liner, if required, for maintenance or replacement purposes. The male part can be removed from the casing support seat and replaced, without removing the casing support seat from the combustor casing. The spring member(s) can again be mounted in the female part and thus be retained on the combustor liner.

During operation of the gas turbine engine 1, vibrations caused by pressure waves generated by the combustion in the combustors 9, as well as vibrations caused by possible unbalance of the rotating parts of the gas turbine engine 1 can cause wear of the interfaces between the combustor liner 15 and outer components of each combustor liner, in particular at the hula seal 21 and at the support elements 19. Worn-out interfaces can be replaced, during normal maintenance interventions.

Replacement of worn parts of a combustor 9 can be performed by removing an end cover 71 (see FIG. 3) along with the burner 27. This makes the combustor liner 15 accessible from the rear side. The cross-fire tubes 13 and other ancillary parts of the combustor 9 can be removed from the combustor liner 15. Afterwards, the combustor liner 15 can be removed according to an insertion-removal direction substantially parallel to axis B-B of combustor 9. After the inspection the combustor liner 15 with the hula seal 21 and the liner support elements 31 can be repaired or replaced by a new one.

The combustor casing 17 is usually not replaced, since it is less subject to wear, or it is replaced less frequently than the combustor liner 15. However, displacements between contacting interfaces between the casing support members 41 and the liner support members 31 cause localized wear of components of the casing support members 41 as well. In particular, the casing stop 45 and the springs 61 may require replacement, since the combined pressure contact of the springs 61 and the dynamic load cause wearing of the surfaces of gap 57 and of the springs 61.

Replacement of these worn components is possible without removing the combustor casing 17. Once the combustor liner 15 has been removed, the operator has simply to unlock the bolts-nuts 51 and remove the casing stop 45 from the casing stop seat 43. The latter remains stably connected to the combustor casing 17 and does not require replacements, since it is not subject to wear.

New casing stops 45 provided with new springs 61 mounted thereon can then be placed in the respective casing stop seats 43 and locked to the combustor casing 17 by means of bolts and nuts 51.

Figure 6:
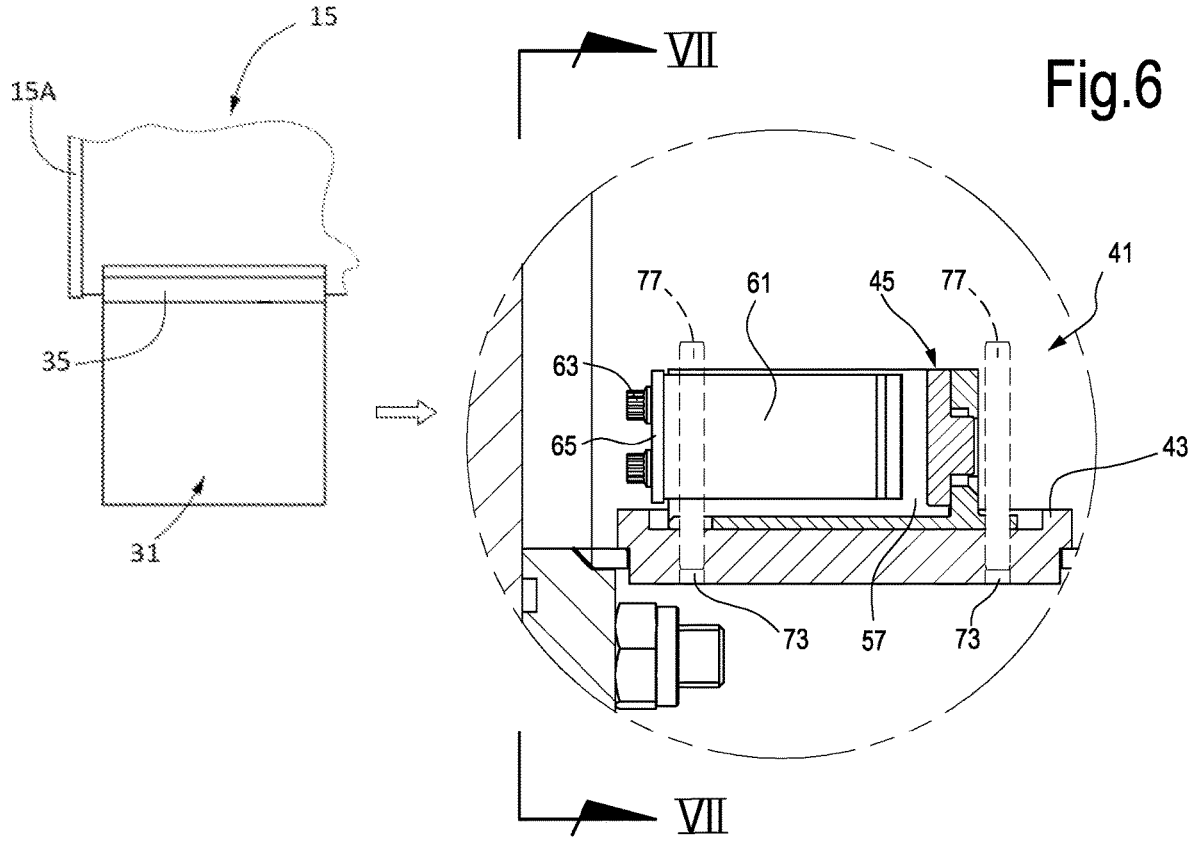
FIG. 6 illustrates an enlargement of the portion marked VI in FIG. 3, showing the support element of FIG. 5 wherefrom the liner support member has been removed for clarity.
Figure 7:
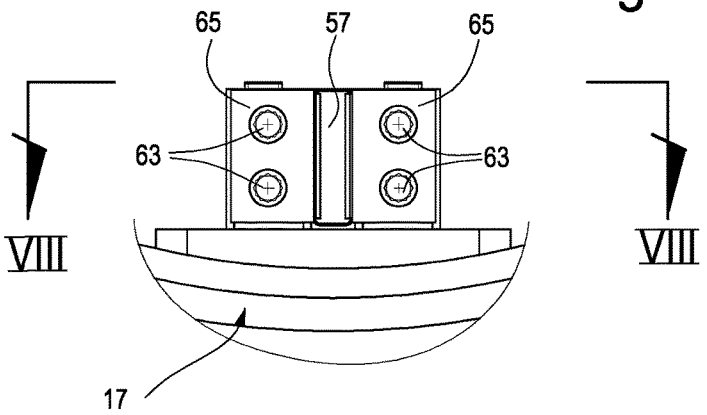
FIG. 7 illustrates a view according to line VII-VII of FIG. 6.
Figure 8:
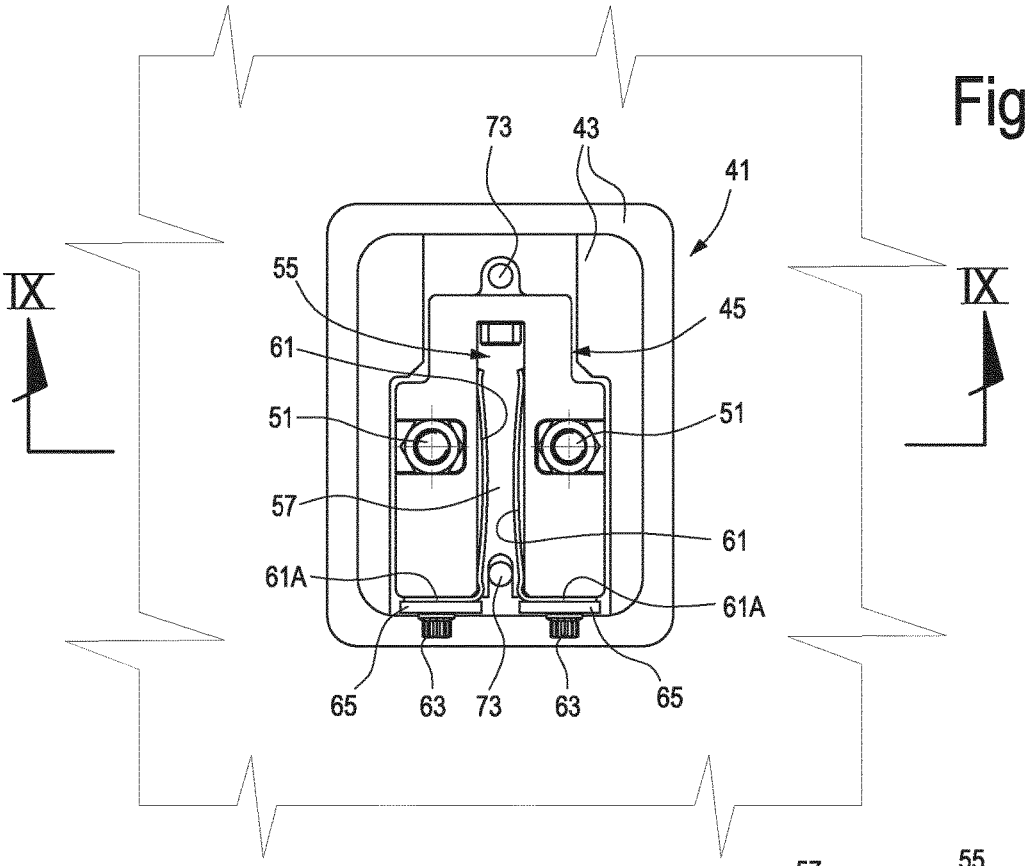
FIG. 8 illustrates a view according to line VIII-VIII of FIG. 7.
Figure 9:
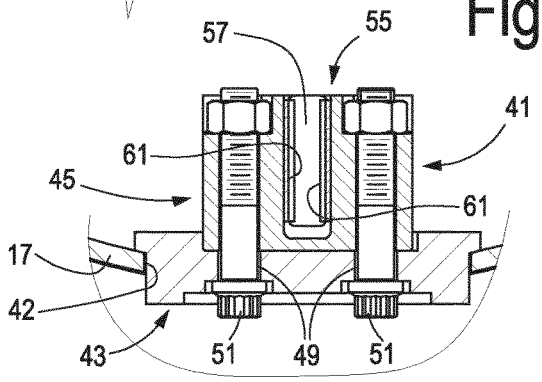
FIG. 9 illustrates a sectional view according to line IX-IX of FIG. 8.

In some embodiments, in order to make mounting of the casing stops 45 in the casing stop seats 43 easier, the bottom of each the casing stop seat 43 can be provided with reference holes 73 (see in particular FIGS. 4, 6 and 8). These holes 73 must be aligned with corresponding holes formed in the corresponding casing stop 45. Dowels 77 (shown in FIG. 6) can be introduced through the aligned holes 73 and the corresponding holes in the casing stop 45, to correctly position the casing stop 45 in the casing stop seat 43. Once the dowels 77 have been inserted into the respective holes, the casing stop 45 can be constrained and locked in the casing stop seat 43 by means of the bolt-nut arrangement 51 and the dowels 77 can be removed prior to mounting the combustor liner 15.

After inspection and possible replacement of the casing stops 45, the combustor liner 15 can be inserted into the combustor casing 17 again according to an insertion direction parallel to the longitudinal axis B-B of the combustor 9. The male parts 37 of each liner stop 33 are thus introduced into the respective gaps 57 of the corresponding casing stops 45 and finally the end cover 71 can be mounted again. Once the male and female parts of the liner stop and casing stop have been inserted one into the other again, the spring member comprised of the two springs 61 applies an elastic force onto the male part in the tangential direction, i.e. orthogonal to the axial insertion direction.

While the disclosed embodiments of the subject matter described herein have been shown in the drawings and fully described above with particularity and detail in connection with several exemplary embodiments, it will be apparent to those of ordinary skill in the art that many modifications, changes, and omissions are possible without materially departing from the novel teachings, the principles and concepts set forth herein, and advantages of the subject matter recited in the appended claims. Hence, the proper scope of the disclosed innovations should be determined only by the broadest interpretation of the appended claims so as to encompass all such modifications, changes, and omissions. In addition, the order or sequence of any process or method steps may be varied or re-sequenced according to alternative embodiments.

The invention claimed is:

1. A gas turbine combustor comprising:

a combustor liner;

a combustor casing, wherein the combustor liner is at least partly housed within the combustor casing and wherein the combustor casing includes one or more combustor casing apertures; and a liner support arrangement having individual support elements located between the combustor liner and the combustor casing, wherein each support element comprises:

a liner support member fixed to the combustor liner, and a casing support member fastened to the combustor casing, wherein each casing support member comprises:

a casing stop seat fixed on the combustor casing, and a replaceable casing stop, detachably coupled to the casing stop seat by at least one screw or at least one bolt and comprising a female part;

wherein each liner support member further comprises a liner stop including a male part positioned within the female part; and wherein a portion of each casing stop seat is positioned within a respective combustor casing aperture.

2. The gas turbine combustor of claim 1, wherein the combustor liner is located substantially concentrically within the combustor casing.

3. The gas turbine combustor of claim 2, wherein the liner support arrangement comprises three support elements.

4. The gas turbine combustor of claim 1, wherein each casing support member comprises at least one spring member constrained to the female part, wherein the at least one spring member is arranged between the casing support member and the liner support member.

5. The gas turbine combustor of claim 4, wherein the female part extends in an insertion direction of combustor.

6. The gas turbine combustor of claim 5, wherein the at least one spring member comprises two springs, arranged on opposing sides of the female part.

7. The gas turbine combustor of claim 6, wherein the two springs are pre-loaded and form an elastic, bilateral tangential constraint between the male part and the female part.

8. The gas turbine combustor of claim 6, wherein the springs are leaf springs.

9. The gas turbine combustor of claim 1, wherein each female part has a U-shaped cross-section having a radially oriented aperture and an axially oriented aperture.

10. The gas turbine combustor of claim 1, wherein each casing stop seat is welded to the combustor casing.

11. The gas turbine combustor of claim 1, wherein each liner support member is welded to the combustor liner.

12. A gas turbine engine comprising:

a compressor section, a combustor section and a turbine section, wherein the combustor section comprises at least one gas turbine combustor according to claim 1.

13. A method for replacing worn components of a gas turbine combustor, the method comprising the following steps:

providing the gas turbine combustor of claim 1;

removing the combustor liner from the combustor casing;

disengaging at least one casing stop from the respective casing stop seat;

introducing a new casing stop in the respective casing stop seat;

locking the new casing stop in the respective casing stop seat;

mounting the combustor liner.

* * * * *